United States Patent [19]

Koike et al.

[11] Patent Number: 4,946,297

[45] Date of Patent: Aug. 7, 1990

[54] PRINTING APPARATUS

[75] Inventors: Mitsuhito Koike; Toshiyuki Suzuki, both of Kodaira, Japan

[73] Assignee: Silver Seiko Ltd., Kodaira, Japan

[21] Appl. No.: 220,151

[22] Filed: Jul. 18, 1988

[30] Foreign Application Priority Data

Jul. 22, 1987 [JP] Japan ..... 62-184410

[51] Int. Cl.[5] ..... B41J 3/54

[52] U.S. Cl. ..... 400/82; 101/93.11

[58] Field of Search ..... 400/82, 158, 120, 26; 346/76 PH; 101/93.11

[56] References Cited

U.S. PATENT DOCUMENTS

| | | | |
|---|---|---|---|
| 2,723,741 | 11/1955 | Carlson | 400/82 |
| 3,878,008 | 2/1975 | Drumbaugh | 400/26 |
| 4,632,585 | 12/1986 | Oyamatsu | 400/120 |
| 4,660,052 | 4/1987 | Kaiya et al. . | |
| 4,692,041 | 9/1987 | Dyma et al. | 400/82 |
| 4,776,711 | 10/1988 | Harada | 400/82 |
| 4,818,126 | 4/1989 | Brooks et al. | 400/120 |

FOREIGN PATENT DOCUMENTS

| | | |
|---|---|---|
| 130373 | 10/1981 | Japan . |
| 146667 | 10/1982 | Japan . |
| 124688 | 7/1983 | Japan . |
| 151072 | 8/1985 | Japan . |
| 210467 | 10/1985 | Japan . |
| 219076 | 11/1985 | Japan . |

OTHER PUBLICATIONS

U.S. Appln. Ser. No. 121,683 filed 11/17/87.

Centronics Technical Manual, Apr. 1984–Model 351 Printer.

*Primary Examiner*—Eugene H. Eickholt

*Attorney, Agent, or Firm*—Cushman, Darby & Cushman

[57] ABSTRACT

A printing apparatus suitable for printing on a print mediumn of a large size which is reduced in overall size and facilitates adjustment of printing timings of line printing heads therein. The printing apparatus comprises a plurality of line printing heads of the type wherein printing elements are disposed on a line along an end edge thereof. The line printing heads are disposed in a pair of rows spaced in the feeding direction of a print medium in a housing such that the printing elements along the end edges thereof are disposed in an alternate relationship in a pair of rows perpendicular to the feeding direction of a print medium and each located nearest to the other row of the printing elements. A pair of parallel rotatable platen means are disposed for cooperation with the pair of rows of printing elements on the line printing heads and include a plurality of platen rollers disposed in an opposing relationship to the line printing heads and a plurality of fixed dummy platens disposed in an alternate relationship with the platen rollers.

9 Claims, 12 Drawing Sheets

PRINTING APPARATUS

BACKGROUND OF THE INVENTION

1. Field of the Invention

This invention relates to a printing apparatus, and more particularly, to a printing apparatus for printing on print paper using a plurality of line printing heads.

2. Description of the Prior Art

Conventionally, a printing apparatus of the type which prints information received from an external or built-in information source is normally designed to print on print paper of a relatively small size. In such a printing apparatus, normally a single printing head is provided.

Printing apparatus for printing on print paper of a large size such as the A-0 or A-1 size of Japanese Industrial Standards are also known. One such printing apparatus is disclosed, for example, in U.S. Pat. No. 4,660,052. In the printing apparatus disclosed, up to four thermal heads, each having heating resistors arranged in a row thereon are arranged in two rows such that the heating resistors thereon are arranged in a pair of parallel rows, and a pair of platen rollers are arranged in a parallel relationship to each other and in an opposing relationship to the pair of parallel rows of the heating resistors. Each of the thermal heads has a pair of marginal portions continuous to the opposite ends of a row of the heating resistors on the head and hence has a greater dimension in the direction of the row of the heating resistors than the length of the row. Accordingly, in order to attain a print of a complete printing line with the four thermal heads, such a zigzag arrangement of the thermal heads as described above is effective.

The thermal heads disclosed in U.S. Pat. No. 4,660,052 are of the type wherein the heating resistors are provided at a substantially central location on the thermal head in the feeding direction of paper perpendicular to the rows of the heating resistors. Accordingly, the thermal heads must be arranged such that the two rows of the heating resistors thereon are spaced from each other by a distance greater than the length of each of the thermal heads in the feeding direction of paper, and therefore, the heating resistors in the two rows are spaced by a comparatively great distance from each other. Such a great distance requires a relatively great number of stepping operations of a stepping motor for feeding print paper and a relatively great size of the printing head assembly and hence, of the entire printing apparatus. Additionally, tolerances in eccentricity of feed rollers for feeding print paper and in parallelism of a pair of platen rollers will have a significant influence on feeding of print paper so that it may be difficult to attain accurate adjustment of printing timings among the thermal heads. Consequently, a high quality of printing may not be attained.

SUMMARY OF THE INVENTION

It is an object of the present invention to provide a printing apparatus which is suitable for printing on a print medium of a large size.

It is another object of the present invention to provide a printing apparatus which is reduced in overall size and facilitates adjustment of printing timings of line printing heads therein.

In order to attain the objects, according to the present invention, there is provided a printing apparatus which comprises a housing, a print medium feeding means for feeding a print medium in one direction in the housing, a plurality of line printing heads of the type wherein printing elements are disposed on a line along an end edge thereof, the line printing heads being disposed in a pair of rows spaced in the feeding direction of a print medium in the housing such that the printing elements along the end edges thereof are disposed in an alternate relationship in a pair of rows perpendicular to the feeding direction of a print medium and each located nearest to the other row of the printing elements, and a pair of parallel rotatable platen means disposed for cooperation with the pair of rows of printing elements on the line printing heads.

With the printing apparatus, the two rows of the printing elements on the line printing heads can be disposed in a spaced relationship by a relatively small distance, and consequently, the printing apparatus can be reduced in overall size and adjustment of printing timings between the line printing heads can be attained readily. Additionally, the influence of eccentricity of feed rollers on feeding of print paper is minimized, and accordingly, a high quality of printing can be attained.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
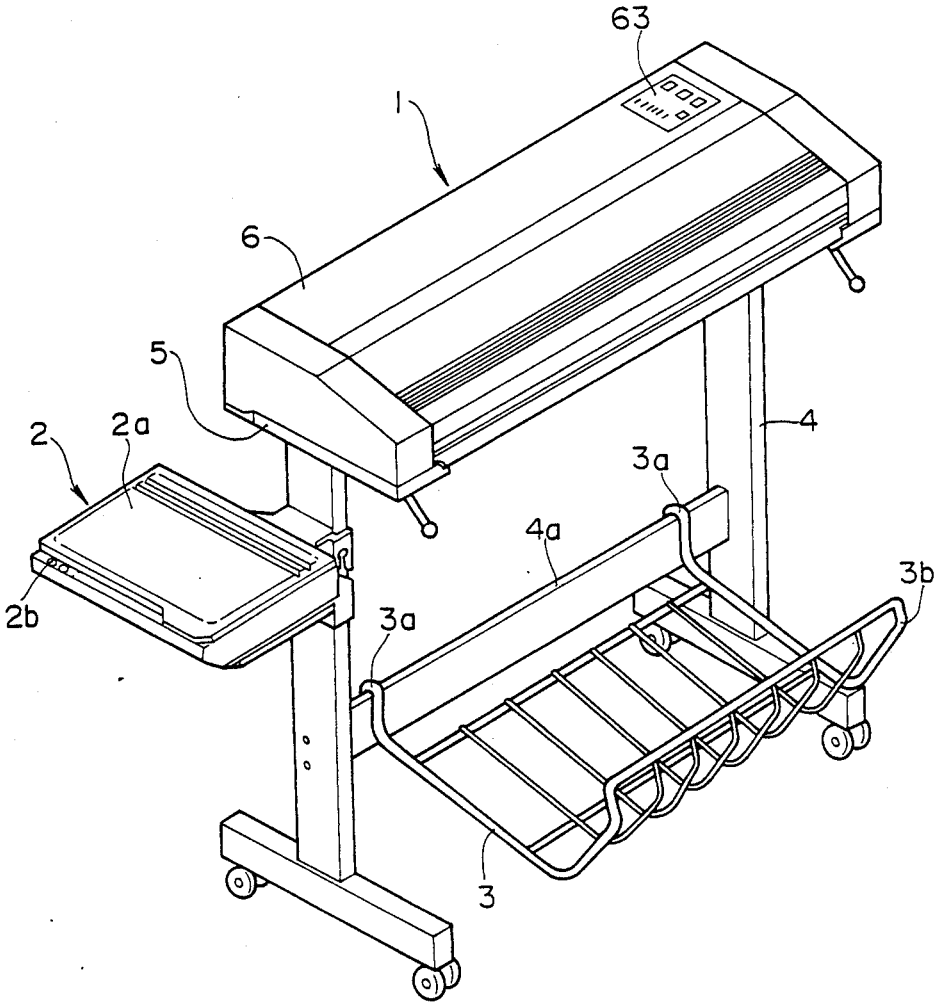
FIG. 1 is a perspective view showing a printing apparatus according to an embodiment of the present invention.

Referring first to FIG. 1, there is shown a printing apparatus embodying the present invention. The printing apparatus here is formed as an enlarging copying machine which includes an enlarging printing section 1 and an original reading section 2 electrically coupled to the enlarging printing section 1 by way of a cable not shown. Thus, an original document of, for example, the A-4 size is read on the original reading section 2, and information of the original document is printed as an enlarged copy of the A-0 size with its length and width enlarged by four times.

The enlarging printing section 1 is mounted on a support frame 4 with casters, and most of components thereof are mounted in a housing which are composed of a lower housing member or fixed base 5 and an upper housing member or movable lid member 6.

Figure 13A:
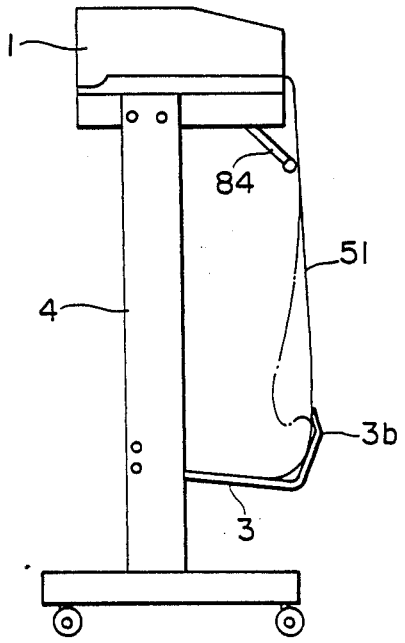
FIGS. 13*a* and 13*b* are schematic side elevational views of the printing apparatus of FIG. 1 illustrating printed print paper being received on a paper tray.
Figure 13B:
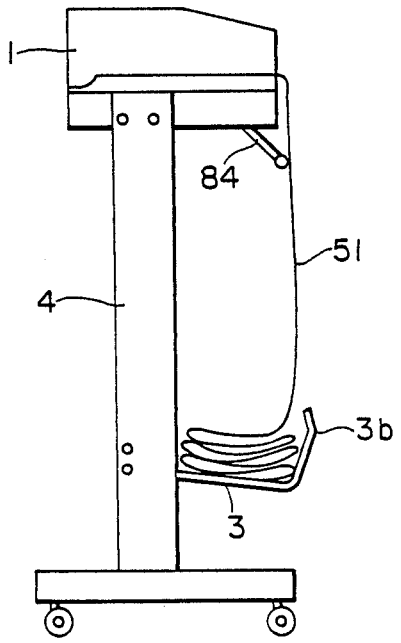

A paper tray 3 is formed from metal bars by bending and welding and has a pair of hooks 3a formed at a rear end thereof. The paper tray 3 is removably mounted on the support frame 4 with the hooks 3a thereof hung on a horizontal cross bar 4a of the horizontal rod 4a. The opposite forward end of the paper tray 3 is bent first in a substantially perpendicularly upward direction in such a manner as to provide a substantially L-shape in side elevation and then in an obliquely rearwardly upward direction so as to form a paper turning back portion 3b for turning back print paper 51 after printing to allow the print paper 51 to be folded on the paper tray 3 with certainty as shown in FIG. 13a or 13b.

Figure 2:
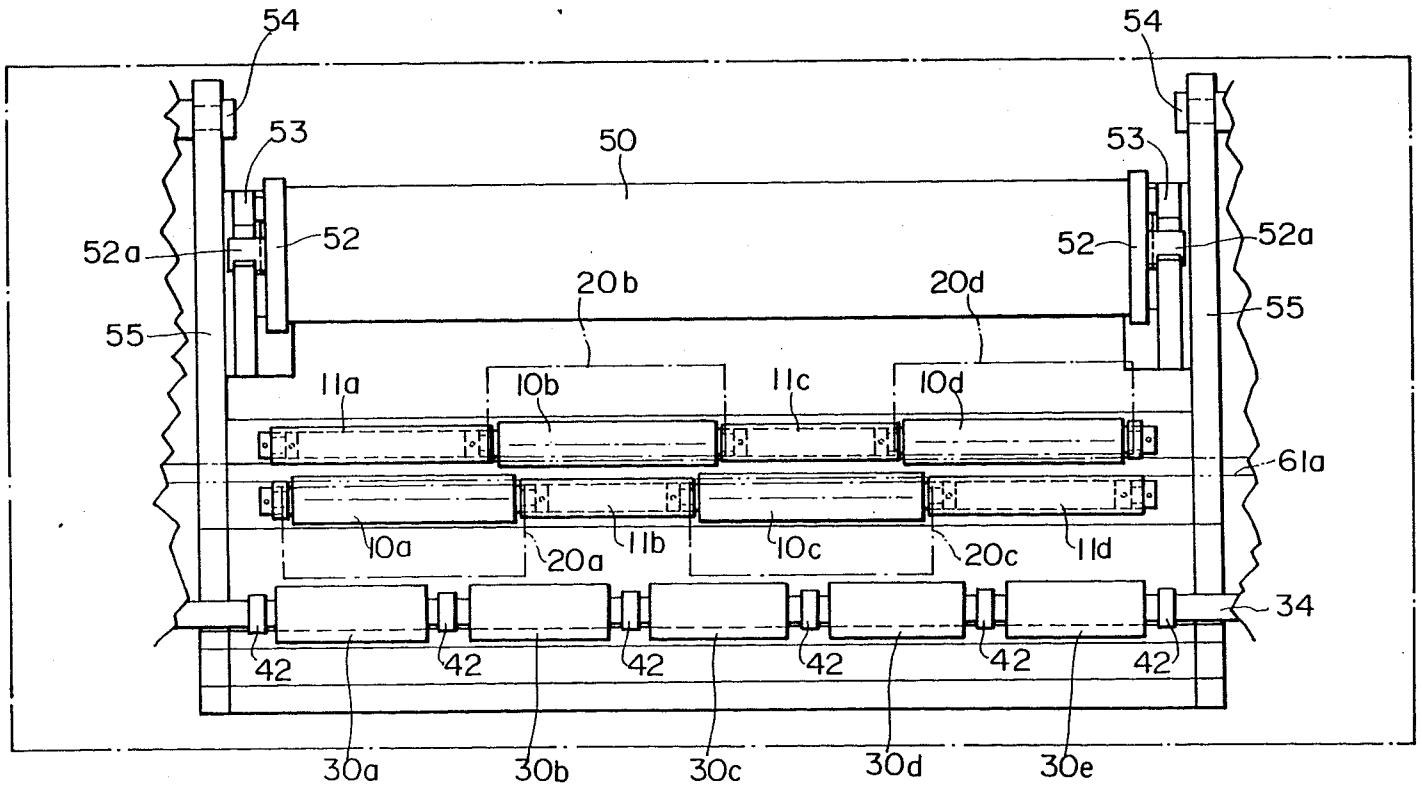
FIG. 2 is a plan view, partly broken, showing an enlarging printing section of the printing apparatus of FIG. 1.
Figure 3:
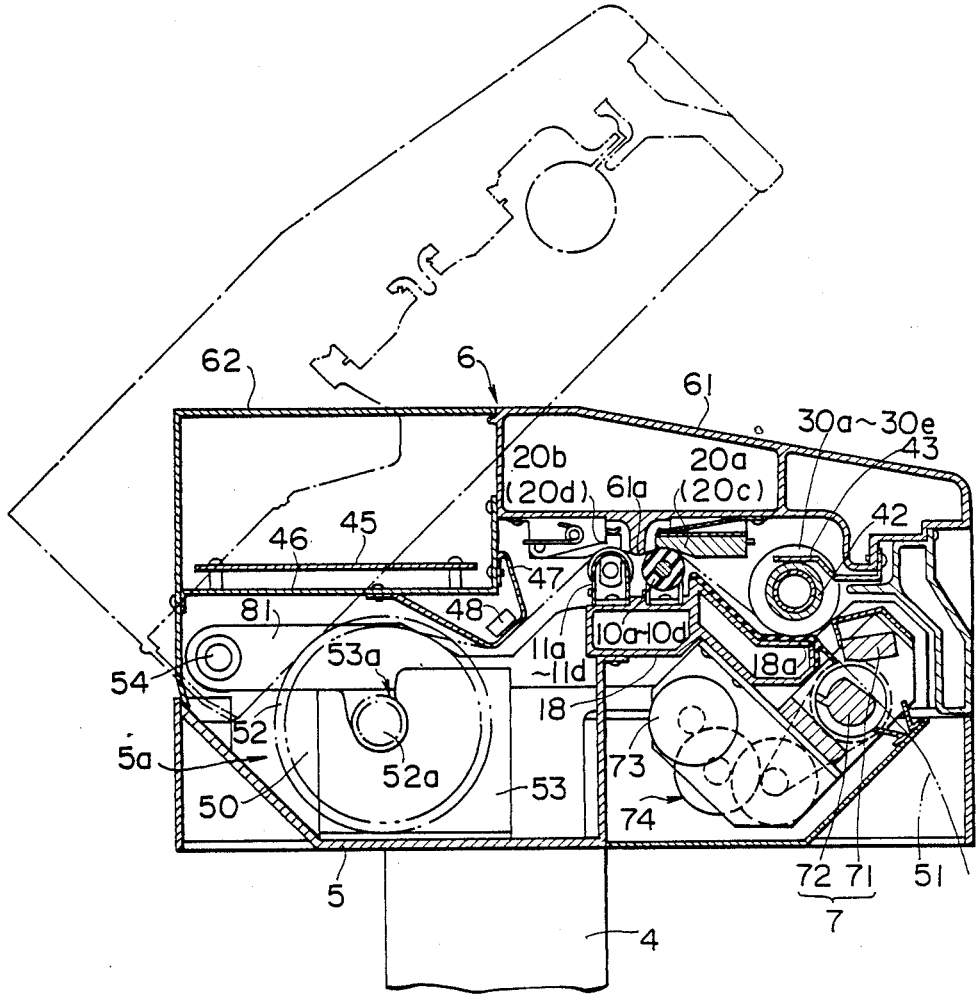
FIG. 3 is a vertical sectional view showing an internal structure of the enlarging printing section of FIG. 2.

Referring to FIG. 3, the fixed base 5 has a paper roll receiving recess 5a formed at a rear half portion (left-hand side half portion in the figure) thereof for accomodating a roll 50 of print paper 51. In the present embodiment, the print paper 51 is in the form of thermosensible paper of the A0 size. A pair of support plates 53 are disposed at the opposite left and right end portions in the paper roll receiving recess 5a in such a manner that the paper roll 50 may be removably disposed for rotation thereon. In particular, each of the support plates 53 has a bearing recess 53a formed rather obliquely from an upper rear portion of an upper end face to a lower front portion thereof. Referring also to FIG. 2, the bearing recesses 53a are provided to receive therein a pair of central outward projections or shafts 52a of rims 52 at opposite ends of the paper roll 50 in such a manner that the paper roll 50 may be rotated smoothly when the print paper 51 is drawn out from the paper roll 50 and the central shafts 52a may not readily come off the bearing recesses 53a.

Meanwhile, several components including up to four platen roller 10a to 10d, four dummy platens 11a to 11d and a rotary cutter 7 are disposed at a front half portion (right-hand side half portion in FIG. 3) of the fixed base 5.

The platen rollers 10a to 10d and the dummy platens 11a to 11d are disposed in two front and rear parallel rows wherein the platen roller 10a, dummy platen 11b, platen roller 10c and dummy platen 11d are arranged in the front row while the dummy platen 11a, platen roller 10b, dummy platen 11c and platen roller 10d are arranged in the rear row as shown in FIG. 2. The platen rollers 10a and 10c and dummy platens 11b and 11d in the front row are securely mounted at a front half of an upper face of a platen pedestal 18 securely mounted on the fixed base 5 while the platen rollers 10b and 10d and dummy platens 11a and 11c in the rear row are securely mounted at a rear half of the upper face of the platen pedestal 14.

Figure 6:
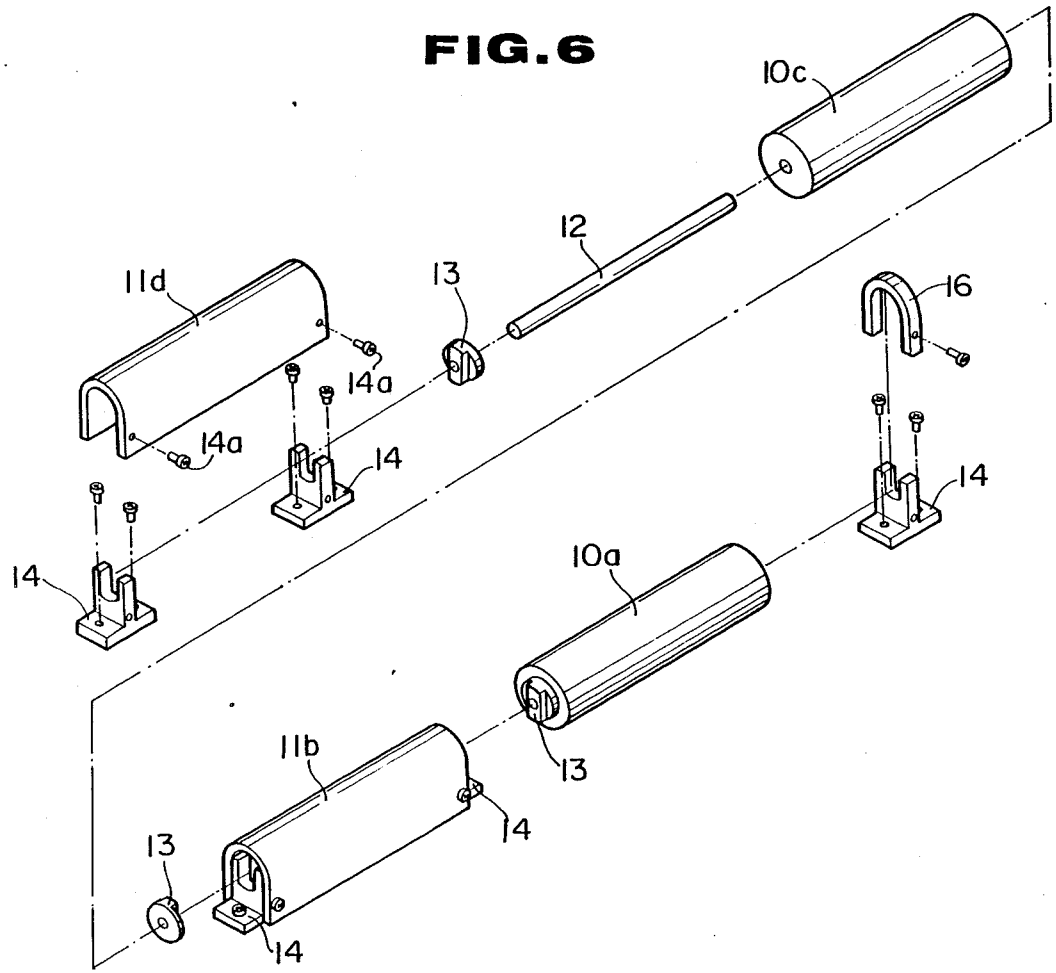
FIG. 6 is a fragmentary perspective view showing a set of platen rollers and dummy platens shown in FIG. 2.

In particular, referring to FIG. 6, each of the dummy platens 11b and 11d in the front row is formed from a plate member having a U-shaped cross section and securely mounted by means of machine screws 14a to rear faces of a pair of support members 14 securely mounted on the platen pedestal 18. Meanwhile, the platen rollers 10a and 10c in the front row are formed from an elastic substance such as rubber, and a shaft 12 extends through each of the platen rollers 10a and 10cand has the opposite ends thereof received in a pair of bearing members 13. The bearing members 13 for the shaft 12 for the platen roller 10c are fitted on adjacent ones of the support members 14 for the dummy platens 11b and 11d while the bearing members 13 for the shaft 12 for the platen roller 10a are fitted on an adjacent one of the support members 14 for the dummy platen 11b and an additional support member 14 secured to the platen pedestal 18. A fixing member 16 is secured to the additional support member 14. The fixing member 16 has a similar U-shaped to the dummy platens 11a to 11d and normally contacts with an end of one of the bearing members 13 for the platen roller 11b remote from the dummy platen 11b to prevent the platen roller 10a from coming off away from the dummy platen 11b. The dummy platens 11a and 11c and the platen rollers 10b and 10d in the rear row are formed and arranged in a similar manner.

Referring to FIG. 2, up to four line thermal heads 20a to 20d are provided in a zigzag pattern or in an alternate relationship in two rows in an opposing relationship above the platen rollers 10a to 10d, respectively, and during printing, the line thermal heads 20a to 20d resiliently pressed againt the platen rollers 10a to 10d as hereinafter described more in detail.

Although it is primarily desirable for a single platen roller of a large size to receive a pressing force of the line thermal heads 20a to 20d disposed in a zigzag pattern, it is difficult to realize a platen roller of such a large size because it readily becomes eccentric due to eccentricity of a shaft of the platen roller itself or due to a pressing force of the line thermal heads 20a to 20d while a high degree of accuracy is required. Meanwhile, it may be advisable to use a single fixed platen for the plurality of line thermal heads arranged in a zigzag pattern. In such an arrangement, however, such a high frictional force may appear between the line thermal heads 20a to 20d and the platen that wrinkles may be produced on print paper 51 between the line thermal heads 20a to 20d located at different forward and rearward positions in the feeding direction of the print paper 51. Accordingly, the plurality of platen rollers 10a to 10d are disposed to reduce the frictional force to prevent appearance of wrinkles and stabilize feeding of the print paper 51.

Meanwhile, if the speed at which the print paper 51 is fed by the platen rollers 10a to 10d is different from the speed of portions of the print paper 51 which pass between the adjacent platen rollers 10a to 10d in the same rows, the print paper 51 may cause jamming or be wrinkled or otherwise be fed obliquely so that correct printing may not be attained. The dummy platens 11a to 11d are provided to apply the frictional force to such portions of the print paper 51 between the adjacent platen rollers 10a to 10d in order to prevent such troubles as described just above. In this instance, the reason why the dummy platens 11a to 11d are not formed as rotatable rollers but formed as fixed members is that they can readily produce a frictional load as high as the frictional force between the line thermal heads 20a to 20d and the platen rollers 10a to 10d. To this end, the dummy platens 11*a* to 11*d* are disposed such that the rounded top ends thereof are positioned a little lower than the top ends of the platen rollers 10*a* to 10*d* as seen from FIG. 3 or 4.

The platen pedestal 18 on which the platen rollers 10*a* to 10*d* and the dummy platens 11*a* to 11*d* are mounted extends obliquely forwardly downwardly from the portion thereof at which the platen rollers 10*a* to 10*d* and the dummy platens 11*a* to 11*d* are mounted and further extends horizontally forwardly. An elastic sheet having a surface processed to decrease the friction thereof is applied to an upper face of the forward extension of the platen pedestal 18, thereby forming a feed roller contacting portion 18 against which a plurality of feed rollers 30*a* to 30*e* are pressed resiliently with a record medium 51 interposed therebetween. The rotary cutter 7 is mounted at a location on the fixed base 5 forwardly of the front end of the platen pedestal 18.

The rotary cutter 7 includes a fixed blade member 71, a rotary blade member 72, and a cutter motor 73. Rotation of the cutter motor 73 is transmitted to the rotary blade member 72 by way of a rotation transmitting means including a reduction gear mechanism 74 so that the rotary blade member 72 is rotated to cooperate with the fixed blade member 71 to cut the print paper 51 put between the fixed blade member 71 and the rotary blade member 72.

The movable lid member 6 is composed of two parts including a front side die-cast portion 61 and a rear side metal plate portion 62. The line thermal heads 20*a* to 20*d* are mounted at a rear location of the front portion 61 of the movable lid member 6 while the feed rollers 30*a* to 30*e* are mounted at a front location of the front portion 61.

The line thermal heads 20*a* to 20*d* are of the common type wherein printing elements in the form of heating resistors are disposed on a line along an end edge thereof. The line thermal heads 20*a* and 20*c* in the front row are mounted on the front portion 61 of the movable lid member 6 such that they may be resiliently pressed under a predetermined pressure against the platen rollers 10*a* and 10*c*, respectively, and the heating resistors thereof are disposed on a line along rear edges (left end in FIG. 3) thereof. Meanwhile, the line thermal heads 20*b* and 20*d* in the rear row are mounted on the front portion 61 of the movable lid member 6 such that they may be resiliently pressed under the predetermined pressure with the platen rollers 10*b* and 10*d*, respectively, and the heating resistors thereof are disposed on a line along front edges (right end in FIG. 3) thereof. The line thermal heads 20*a* to 20*d* are thus arranged in a zigzag pattern or in other words, in an alternate relationship in a pair of front and rear rows with the orientations thereof reversed in the front and rear rows.

The reason why the plurality of line thermal heads 20*a* to 20*d* are arranged in such a zigzag pattern with the orientations thereof reversed in the front and rear rows is that the arrangement is effective to enable full line printing with the heating resistors of the line thermal heads 20*a* to 20*d* and reduce the distance between the front and rear rows of the heating resistors of the line thermal heads 20*a* to 20*d* to facilitate adjustment of printing timings of the line thermal heads 20*a* to 20*d* and imnprove the quality of printed results.

It is to be noted that, with the arrangement of the line thermal heads 20*a* to 20*d* described above, printing commands to be fed to the line thermal heads 20*a* and 20*c* in the front row and to the line thermal heads 20*b* and 20*d* in the rear row are staggered in accordance with the distance between the two rows.

A tension applying projection or rib 61*a* is formed at a location of the lower face of the front portion 61 of the movable lid member 6 between the front and rear rows of the line thermal heads 20*a* to 20*d*. The tension applying rib 61*a* extends downwardly between the line thermal heads 20*a* and 20*c* in the front and rear rows of the line thermal heads 20*b* and 20*d* to a position, when the movable lid member 6 is in a closed position, a little below a plane of the tops of the platen rollers 10*a* to 10*d* between the front row of the platen rollers 10*a* and 10*c* and dummy platens 11*b* and 11*d* and the rear row of the platen rollers 10*b* and 10*d* and dummy platens 11*a* and 11*c*. When the movable lid member 6 is closed as shown in solid lines in FIG. 3, a lower rounded end or edge of the tension applying rib 61*a* is thus contacted with a portion of print paper 51 between the front and rear rows of the platen rollers 10*a* to 10*d* and dummy platens 11*a* to 11*d* to provide a suitable tension to the print paper 51. Accordingly, the print paper 51 is closely contacted with the platen rollers 10*a* and 10*c* and the platen rollers 10*b* and 10*d* on the front and rear rows only by closing the movable lid member 6. Consequently, overlapping line printing by the line thermal heads 10*b* and 10*d* in the rear row which may arise from slackening of the print paper 51 between the platen rollers 10*a* and 10*c* an the platen rollers 10*b* and 10*d* can be eliminated and the appearance of wrinkles on the print paper 51 can also be prevented.

Figure 7:
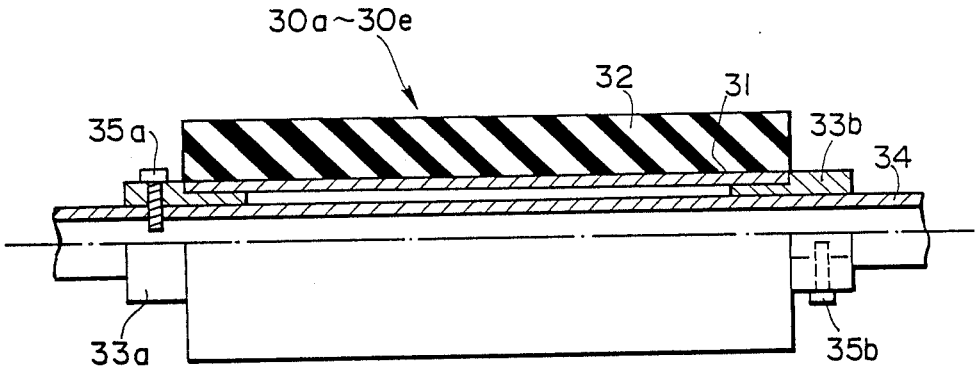
FIG. 7 is a front elevational and vertical sectional view, in an enlarged scale, of a feed roller shown in FIG. 2.

Referring to FIG. 7, each of the feed rollers 30*a* to 30*e* includes a pair of fixing rings 33*a* and 33*b* secured by press fitting to the opposite ends of a roller tube 31 which is thickly covered with an elastic body 32 made of rubber or a like material. The fixing rings 33*a* and 33*b* are fitted on an outer periphery of a cylindrical feed shaft 34 and secured at different positions thereof by 180 degrees to the feed shaft 34 by means of a pair of machine screws 35*a* and 35*b*, respectively.

Since of the feed rollers 30*a* to 30*e* are securely screwed at two locations differing by 180 degrees around the feed shaft 34 and at axially opposite end portions thereof by means of a pair of machine screws 35*a* and 35*b*, several advantages can be anticipated in comparison to a conventional arrangement wherein a feed roller is secured at four locations, two for each of the axially opposite end portions differing by 180 degrees around a feed shaft. The number of fastening screws and the number of screw fastening operations are reduced. The balancing adjustment between the machine screws is eliminated, and, with a printing apparatus wherein such a plurality of feed rollers 30*a* to 30*e* are provided, a high degree of accuracy is attained and paper is fed smoothly.

The feed shaft 34 is fitted at the opposite ends thereof in a pair of elongated guide holes perforated in a pair of pivotal side plates 55 (refer to FIG. 4) such that it may slidably move upwarly or downwardly within a range of the guide holes when the movable lid member 6 is in its closed position. The pivotal side plates 55 are securely mounted at locations near a pair of opposite left and right walls of the movable lid member 6, and a pair of bushes (not shown) are secured to the opposite ends of the feed shaft 34 outside the pivotal side plates 55 to prevent the latter from coming off in its axial direction. Referring to FIGS. 2 and 3, a plurality of rings 42 are mounted in an equidistantly spaced relationship on the feed shaft 34 at locations between the feed rollers 30*a* to 30e and at locations of the opposite end portions. The rings 42 are normally contacted and urged downwardly by a corresponding plurality of leaf spring members 43 which are mounted in an equidistantly spaced relationship in the direction of an axis of the feed shaft 34 on the front portion 61 of the movable lid member 6 so that the feed rollers 30a to 30e on the feed shaft 34 may be pressed resiliently against the feed roller contacting portion 18a of the platen pedestal 18.

It is to be noted that the feed rollers 30a to 30e are different in number from the line thermal heads 20a to 20d and are located such that each of overlapping portions of the line thermal heads 20a to 20d, as viewed in the feeding direction of print paper 51 can oppose and align with the feed rollers 30b, 30c or 30d as particularly seen from FIG. 2. The specific arrangement of the feed rollers 30a to 30e, particularly of the feed rollers 30b to 30d, is adopted in order that an additional load which may be applied to the print paper 51 at each of such overlapping portions to make paper feeding non-uniform over the entire width of the print paper 51 may be compensated for to assure smooth paper feeding.

Figure 4:
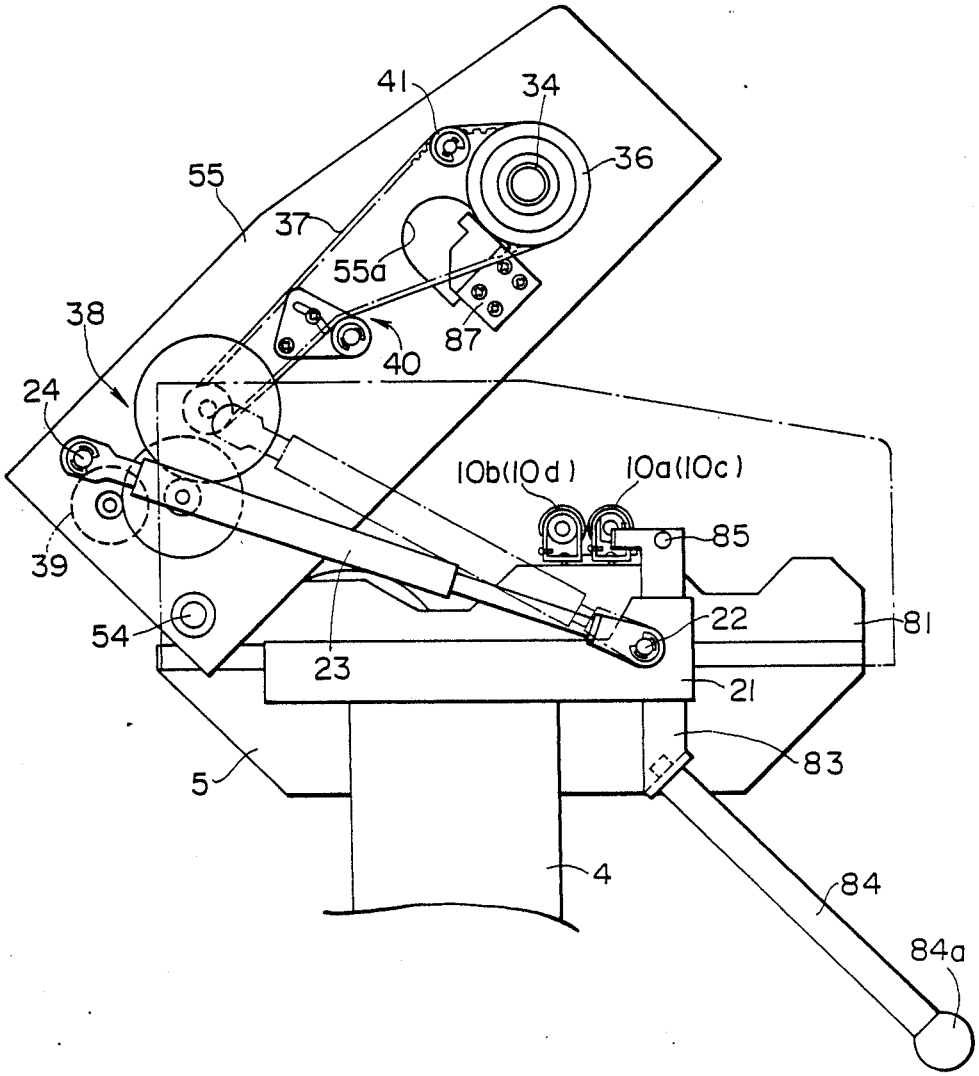
FIG. 4 is a side elevational view showing the enlarging printing section of FIG. 2 with a side wall omitted.
Figure 5:
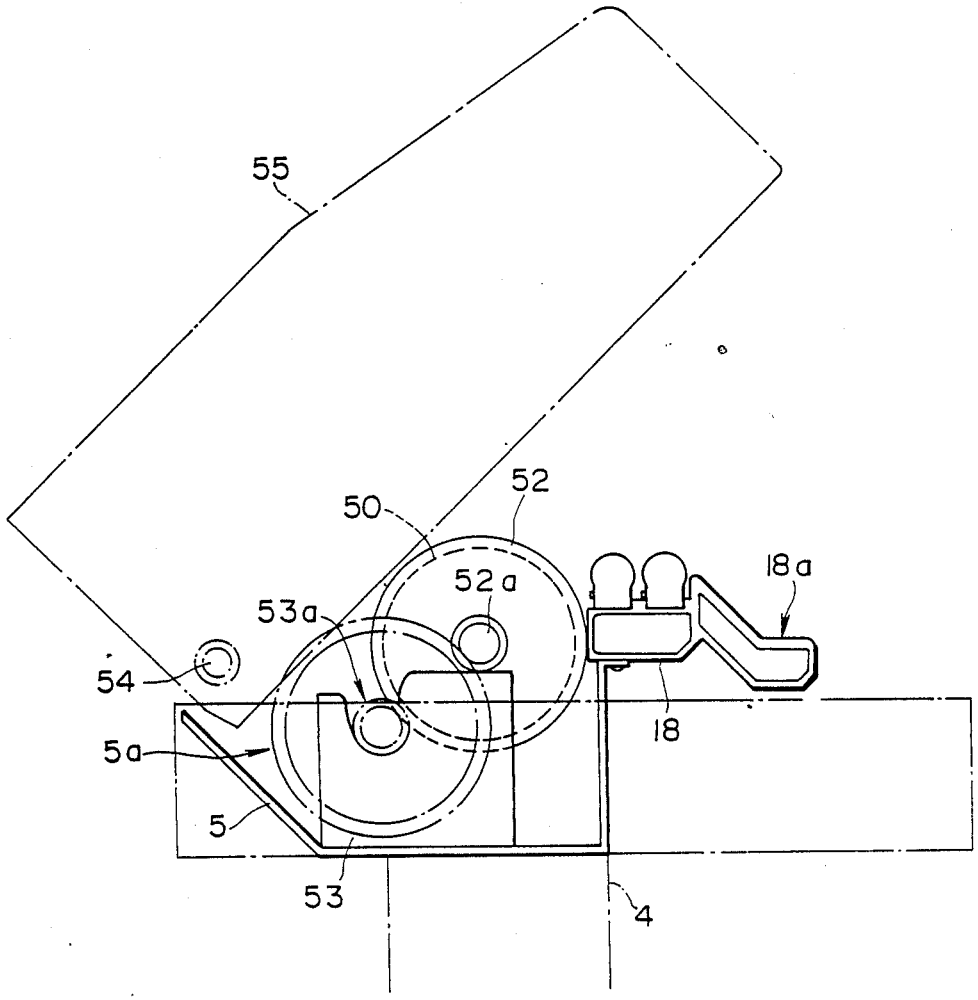
FIG. 5 is a schematic view illustrating a paper roll being set in the enlarging printing section of FIG. 2.

Referring now to FIG. 4, a feed pulley 36 is securely mounted at an end portion (left end in FIG. 2) of the feed shaft 34 which extends outwardly from the left-hand side pivotal side plate 55. The feed pulley 36 is connected to a feed motor 39 by way of a timing belt 37 and a speed reduction gear mechanism 38.

The timing belt 37 is adjusted in tension thereof by a tension adjusting mechanism 40 and extends to the feed pulley 36 past an idler gear 41. The idler gear 41 is located such that the load applied to the feed shaft 34 by the timing belt 37 may have a minimized component of force which acts to urge the feed shaft 34 in the rearward direction (leftwardly downward direction in FIG. 4).

Referring back to FIG. 3, a circuit board 45 is mounted in the rear portion 62 of the movable lid member 6, and various electric elements (not shown) forming a controlling circuit of the printing apparatus are mounted on the circuit board 45. The circuit board 45 is shielded by a shield plate 46 securely mounted on the rear portion 62 of the movable lid member 6 so that it may not be exposed to the outside when the movable lid member 6 is opened. A paper guide plate 47 is mounted at a front portion of the shield plate 46, and an empty paper sensor 48 in the form of a microswitch is mounted on the paper guide plate 47 and has a movable contact element (not shown) projected downwardly slightly through a hole perforated in the paper guide plate 47.

Referring to FIG. 1, an operation panel 63 for the enlarging printing section 1 of the printing apparatus is provided on an upper face of the movable lid member 6.

The fixed base 5 and the movable lid member 6 are connected for pivotal motion to each other in such a manner that the pivotal side plates 55 securely mounted on the movable lid member 6 are pivotally supported on a pair of pivot shafts 54 mounted near rear ends of a pair of fixed side plates 81 securely mounted on the fixed base 5.

Figure 9:
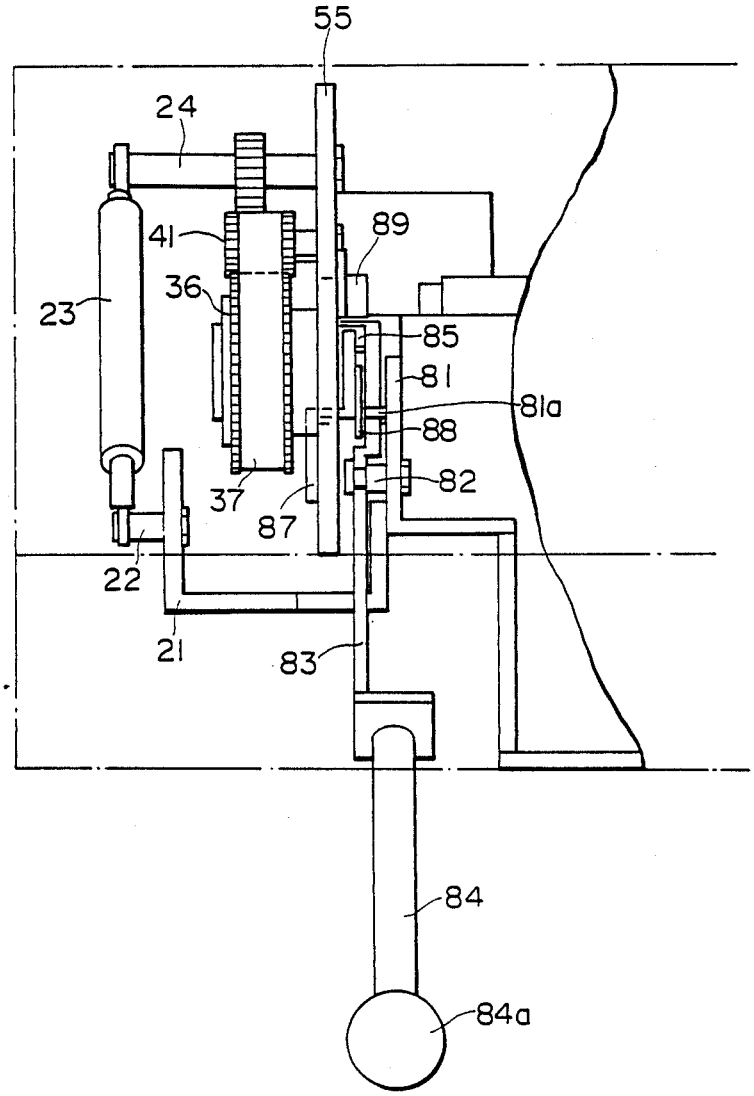
FIG. 9 is a partial front elevational view of the opening and closing mechanism of FIG. 8.

Referring to FIGS. 4 and 9, each of the fixed side plates 81 has a support plate 21 formed in an integral relationship thereon. The support plate 21 extends first horizontally outwardly below the corresponding pivotal side plate 55 and then vertically upwardly, and an air damper 23 is connected at an end thereof for rocking motion around a pin 22 at a location near a forward end of the upward extension of the support plate 21. The air damper 23 is connected at the other end thereof for rocking motion around a pin 24 mounted near a rear end of the pivotal side plate 55. The air damper 34 normally exerts an extending resilient force for urging the pivotal side plate 55 to pivot the movable lid member 6 in the counterclockwise direction in FIG. 4, that is, to open the movable lid member 6 upwardly, around the axis of pivot shafts 54.

Figure 8:
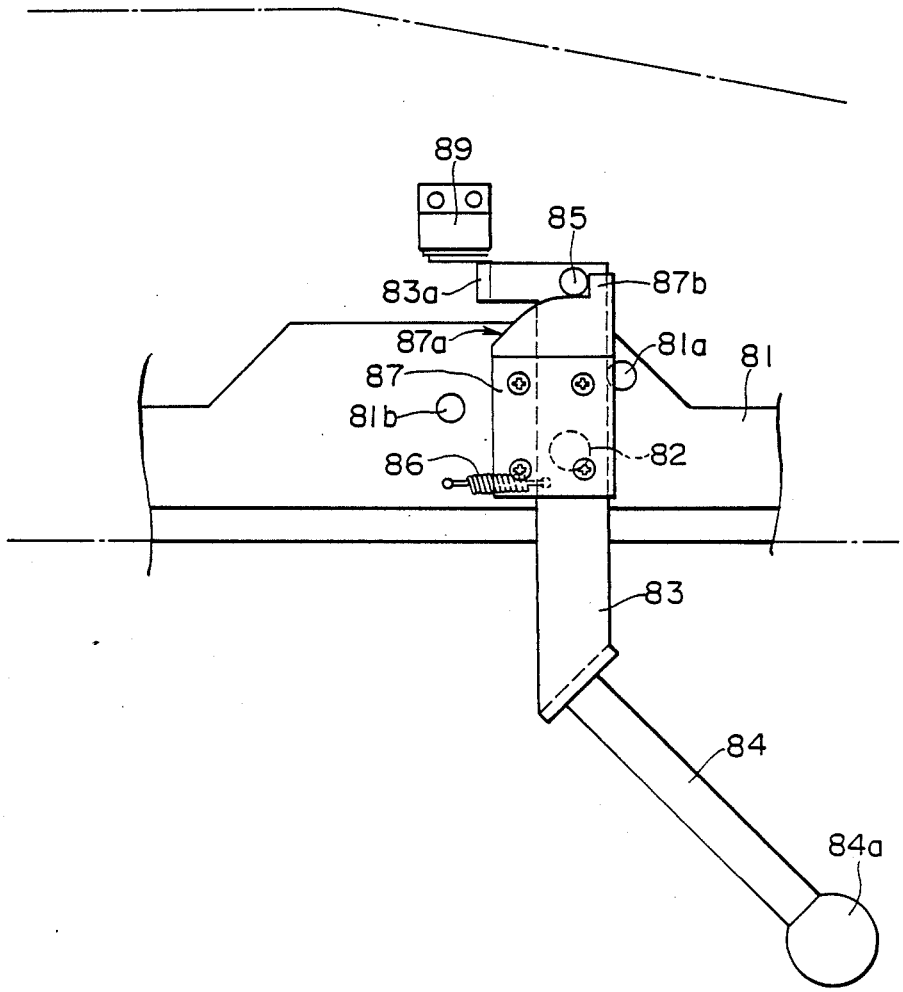
FIG. 8 is an enlarged partial side elevational view showing an opening and closing mechanism of the enlarging printing section of FIG. 2.
Figure 12:
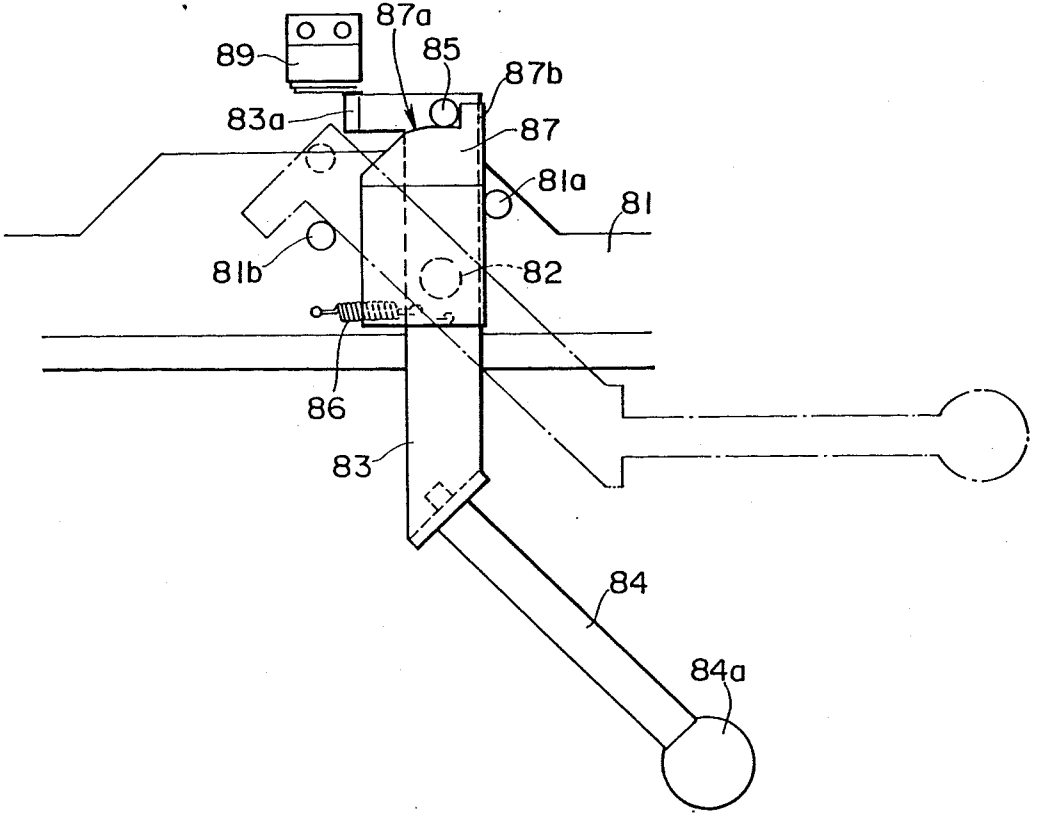
FIG. 12 is a similar view but showing the operating lever in another different position.

Referring to FIGS. 8 and 9, a support shaft 82 is mounted on each of the fixed side plates 81, and a rocking lever 83 is supported for rocking motion on the support shaft 82. The rocking lever 83 is normally urged to pivot in the clockwise direction in FIG. 8 around the support shaft 82 by a compression coil spring 86 which is anchored at an end thereof at the rocking lever 83 and the other end thereof at the fixed side plate 81. Pivotal motion of the rocking lever 83 by the resilient force of the coil spring 86 is limited at a predetermined position by a stopper pin 81a mounted on the fixed side plate 81 while pivotal motion of the rocking lever 83 against the resilient force of the coil spring 86 is also limited at another predetermined position shown in phantom in FIG. 12 by another stopper pin 81b mounted on the fixed side plate 81.

An operating member 84 is securely mounted at an end thereof to the lower end of the rocking lever 83 while a knob 84a is securely mounted at the other end of the operating rod 84.

A pin 85 is mounted at an upper end portion of the rocking lever 83 for engaging with a cam plate 87 securely mounted on an outer face of the pivotal side plate 55 and also with a cam member 88 secured to the cam plate 87. A pressing piece 83a in the form of a bent lug is formed at the rear end of the upper end portion of the rocking lever 83. The pressing piece 83a is located for engagement with a resilient contact of a lid opening detecting sensor 89 in the form of a microswitch mounted on the pivotal side plate 55.

Figure 10A:
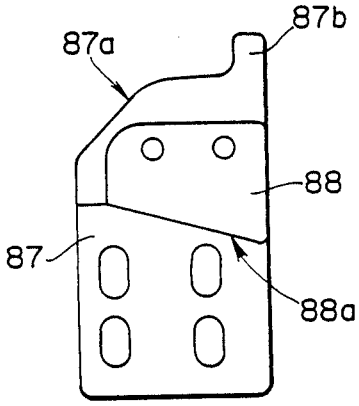
FIGS. 10*a* and 10*b* are a side elevational view and a front elevational view showing a cam plate and a cam member shown in FIG. 9, respectively.
Figure 10B:
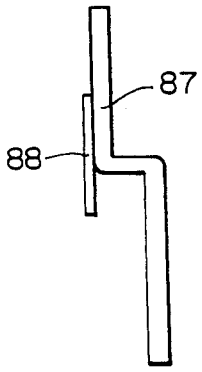

Referring to FIGS. 10a and 10b, the cam plate 87 is formed from a plate member having an intermediate offset portion. The cam plate 87 has a cam edge or face 87a and a stopping projection 87b formed at the top end thereof for engaging with the pin 85 on the rocking lever 83. Meanwhile, the cam member 88 has an inclined cam edge or face 88a formed at the bottom end thereof and is secured to an inner face (left-hand side face in FIG. 10b) of an upper portion of the cam plate 87 by welding or by suitable some other means. The cam plate 87 is secured at a lower portion thereof to the outer face of the pivotal side plate 55 by machine screws or by some other suitable fastening means. The cam plate 87 extends at the offset portion thereof through a perforation 55a (refer to FIG. 4) perforated in the pivotal side plate 55 to the inner side of the pivotal side plate 55. The cam member 88 securely mounted on the inner face of the upper portion of the cam plate 87 is thus positioned inwardly of the pivotal side plate 55.

Referring back to FIG. 1, the picture image reading section 2 is designed such that if a lid member 2a is opened and then an original document is placed on an original table (not shown) whereafter the lid member 2a is closed again and then a reading switch 2b is depressed, then a picture image of the original is read as digital picture image information by a line image sensor (not shown) installed in the picture image reading section 2. Digital picture image information thus produced is transferred to the enlarging printing section 1 by way of the cable not shown.

It is to be noted that information of a picture image to be printed on the printing apparatus may otherwise be transmitted to the enlarging printing section 1 from some other suitable signal generating means or information transmitting means such as, for example, a microcomputer.

Subsequently, operation of the printing apparatus of the present embodiment having such a construction as described above will be described.

Figure 11:
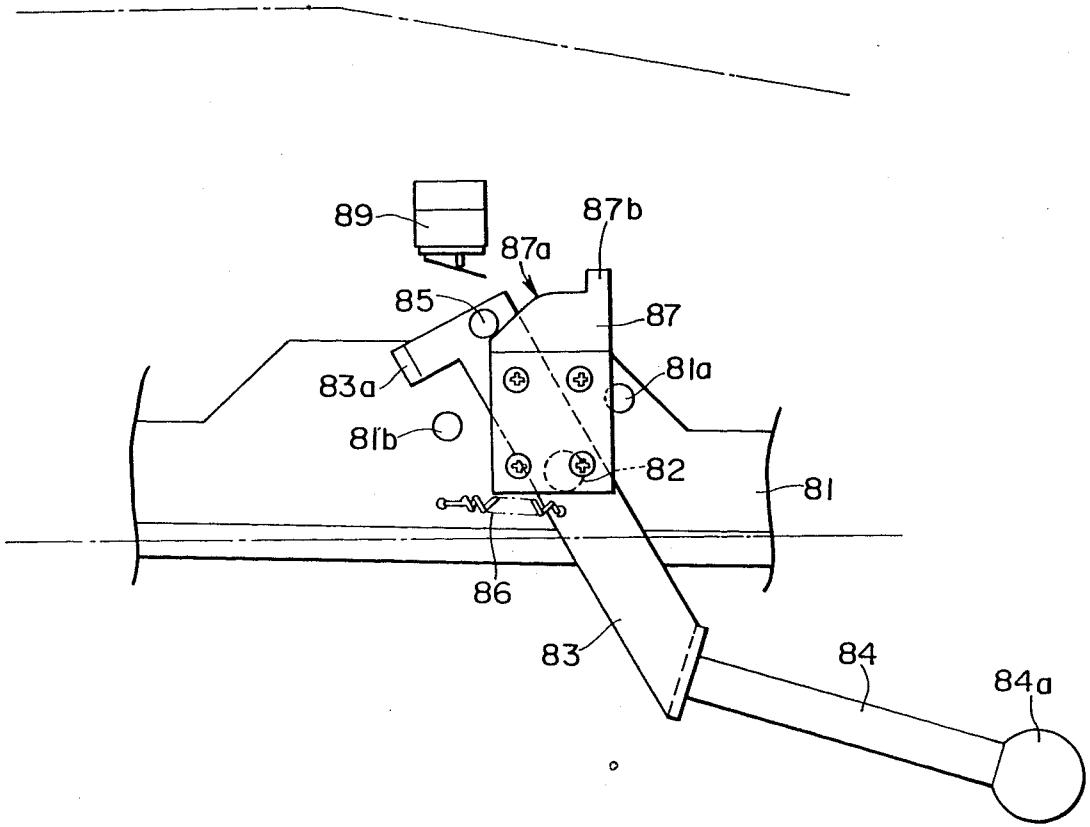
FIG. 11 is a view similar to FIG. 8 but showing an operating lever in a different position.

At first, print paper 51 must be set in position in the enlarging printing section 1. To this end, the knobs 84*a* of the operating rods 84 extending downwardly below the fixed base 5 are gripped by both hands and pushed down to the operator's side (in the counterclockwise direction in FIG. 8). In this instance, each of the rocking levers 83 is pivoted around the support shaft 82 against the resilient force of the urging spring 86 as shown in FIG. 11 so that the pin 85 moves along and then slips down on the cam face 87*a* of the cam plate 87 whereupon the resilient contact of the lid opening detecting sensor 89 is disengaged from the pressing piece 83*a* of the rocking lever 83 as seen in FIG. 11 and thus detects that the movable lid member 6 is now open. When the pin 85 is finally disengaged from the cam face 87*a* of the cam plate 87, the movable lid member 6 is released from its locked condition by the fixed base 5 so that it is subsequently pivoted in the counterclockwise direction in FIG. 3 around the axis of the pivot shafts 54 together with the pivotal side plates 55 by the urging forces of the air dampers 23 until it is fully opened as shown in phantom in FIG. 3 or as shown in solid lines in FIG. 4. Then, if the rocking levers 83 are contacted with and stopped by the stopper pins 81*b*, the operator may let go of the knobs 84*a* on the operating rods 84. Consequently, the rocking levers 83 are pivoted back around the support shafts 82 by the urging forces of the coil springs 86 to their home position at which they contact with the stopper pins 81*a* as shown in FIG. 8.

When the movable lid member 6 is in its open position, the line thermal heads 20*a* to 20*d* and the feed rollers 30*a* to 30*e* on the movable lid member 6 are spaced by a sufficient enough distance from the platen rollers 10*a* to 10*d*, dummy platens 11*a* to 11*d* and platen pedestal 18 to allow a paper roll 50 to be put in position into the paper roll storing portion 5*a*.

In order to put the paper roll 50 into a paper roll storing portion 5*a*, the central shafts 52*a* of the rims 52 at the opposite ends of the paper roll 50 are placed on upper end edges or faces of the support plate members 53 disposed at the opposite left and right end portions in the paper roll receiving recess 5*a*. Then, the paper roll 50 is pushed to roll rearwardly on the upper end edges of the support plate members 53 until the central projected shafts 52*a* come to the bearing recesses 53*a* of the support plate members 53 whereupon the paper roll 50 drops into the paper roll accommodating recesses 5*a* due to its own weight until the central projected shafts 52*a* are received in the bearing recesses 53*a*, thereby completing setting of the paper roll 50 in position into the enlarging printing section 1. In this manner, a paper roll 50 can be set in position very easily.

After completion of setting of the paper roll 50, an end of the print paper 51 is pulled out from the paper roll 50 and is then passed along the platen rollers 10*a* to 10*d*, dummy platens 11*a* to 11*d* and platen pedestal 18, between the fixed blade member 71 and the rotary member 72 of the rotary cutter 7 and drawn out downwardly from the lower bottom portion of the enlarging printing section 1, thereby completing threading of the print paper 51 in the enlarging printing section 1.

It is to be noted that, when the movable lid member 6 is in the open position, the platen rollers 10*a* to 10*d*, dummy platens 11*a* to 11*d*, line thermal heads 20*a* to 20*d* and feed rollers 30*a* to 30*e* are exposed and maintenance of the components including repair, replacement and so on can be done readily. If the shield plate 46 is removed, then maintenance of the circuit board 45 and so on can also be done readily.

After completion of threading of the print paper 51, a front portion of the movable lid member 6 is pushed to pivot downwardly from the open or upwardly pivoted position. Upon such pivotal motion of the movable lid member 6, the pivotal side plates 55 are pivoted around the axis of the pivot shafts 54 against the resilient forces of the air dampers 23 until the movable lid member 6 comes to its closed position. In the course of the closing movement of the movable lid member 6, each of the pins 85 on the rocking levers 83 is first engaged with and then guided by the cam face 88*a* of the cam member 88 mounted on the reverse face of the cam plate 87 to pivot the rocking lever 83 against the resilient force of the coil spring 86 so that the pin 85 may not collide with the cam plate 87. After the pin 85 rides over the cam face 88*a* of the cam member 88, it is engaged with and stopped by a rear end portion of the cam face 87*a* of the cam plate 87 to stop the rocking lever 83 at such an intermediately pivoted position as shown in FIG. 11. In this position of the rocking levers 83, the movable lid member 6 is not in its completely closed position. The operator will thus grip and push down the knobs 84*a* of the operating rods 84 strongly. Thereupon, each of the pins 85 rides along the cam face 87*a* of the cam plate 87 until it is contacted with and stopped by the stopping projection 87*b*, thereby locking the movable lid member 6 at its completely closed position on the fixed base 5. In the completely closed position of the movable lid member 6, the lid opening detecting sensor 89 detects the closed position of the movable lid member 6 due to engagement of the resilient contact thereof by the pressing piece 83*a* of the rocking lever 83 while the empty paper sensor 48 detects the presence of the print paper 51 which extends through the enlarging printing section 1.

As a result of such pivotal motion of the movable lid member 6 to its completely closed position, the line thermal heads 20*a* to 20*d* and the feed rollers 30*a* to 30*e* are pressed against the platen roller 10*a* to 10*d* and the platen pedestal 18, respectively, with the print paper 51 interposed therebetween, and the print paper 51 is set in the enlarging printing section 1. In this instance, since the tension applying rib 61*a* contacts an upper face of a portion of the print paper 51 between the front row of the platen rollers 10*a* and 10*c* and dummy platens 11*b* and 11*d* and the rear row of the platen rollers 10*b* and 10*d* and dummy platens 11*a* and 11*c* and pushes down the portion of the print paper below the plane of the tops of the platen rollers 10*a* to 10*d*, a suitable tension is applied to the print paper and possible slackening of the print paper is taken up.

Subsequently, the lid member 2*a* of the original reading section 2 is opened and an original is set in position on the original table whereafter the lid member 2*a* is closed again and the reading switch 2*b* is depressed. Consequently, the line image sensor installed in the original reading section 2 scans the original and transfers digital picture image information of the original to the enlarging printing section 1 via the cable not shown.

In the enlarging printing section 1, the digital picture image information transferred thereto from the original reading section 2 is stored in a page memory not shown.

After the digital picture image information of the entire original for one page has been stored into the page memory, a start switch (not shown) provided on the operation panel 63 of the enlarging printing section 1 is depressed. As a result, a printing operation is started on the enlarging printing section 1.

Upon starting of the printing operation, the feed motor 39 is energized to rotate so that the feed shaft 34 is rotated via the speed reduction gear mechanism 38, timing belt 37 and feed pulley 36. Consequently, the feed rollers 30*a* to 30*e* are rotated to feed the print paper 51 rightwardly in FIG. 3. Simultaneously, the line thermal heads 20*a* to 20*d* are driven in response to the digital picture image information successively recalled from the page memory to successively print on the print paper 51. In this instance, printing commands to be fed to the line thermal heads 20*a* and 20*c* in the front row and to the line thermal heads 20*b* and 20*d* in the rear row are staggered in accordance with the distance between the two rows as described hereinabove.

The print paper 51 thus printed is then discharged from the enlarged printing section 1 and falls due to its own weight toward the paper tray 3 mounted on the support frame 4. As the print paper 51 is discharged successively, a leading end portion thereof first reaches and is received on the paper tray 3 as shown in FIG. 13*a* whereafter the print paper 51 is successively received in an overlapping manner or in a zigzag pattern as shown in FIG. 13*b* due to a turning over action of the paper turning back portion 3*b* at the top end of the paper tray 3.

When printing for the one page is completed, driving of the line thermal heads 20*a* to 20*d* is stopped. The feed motor 39, however, is further energized either automatically or in response to an instruction from the outside so that the print paper 51 is fed by an additional distance equal to or greater then the distance between the position of the thermal heads 20*a* and 20*c* and the position of the rotary cutter 7 in the paper feeding direction until the last printed portion of the print paper 51 advances by a desired distance farther than the rotary cutter 7. After such additional feeding of the print paper 51, the driving of the feed motor 39 is stopped, and the cutter motor 74 is energized to drive the rotary cutter 7 to cut off the printed portion of the print paper 51. An end portion of the print paper 51 thus cut drops from the enlarging printing section 1 and is received by the paper tray 3.

It is to be noted that, while in the embodiment described above the line printing heads have been described as line thermal heads, the line printing heads may be of any other type.

Having now fully described the invention, it will be apparent to one of ordinary skill in the art that many changes and modifications can be made thereto without departing from the spirit and scope of the invention as set forth herein.

What is claimed is:

1. A printing apparatus, comprising a housing, a print medium feeding means for feeding a print medium in one direction in said housing, a plurality of line printing heads of the type wherein printing elements are disposed on a line along an end edge thereof, said line printing heads being disposed in a pair of rows spaced in the feeding direction of a print medium in said housing such that said printing elements along said end edges thereof are disposed in an alternate relationship in a pair of rows perpendicular to the feeding direction of a print medium and each located nearest to the other row of the printing elements, and a pair of parallel rotatable platen means disposed for cooperation with said pair of rows of printing elements on said line printing heads each of said platen means including a plurality of platen rollers disposed in an opposing relationship to the printing elements on the line printing heads on a corresponding one of said pair of rows of said line printing heads.

2. A printing apparatus as claimed in claim 1, wherein each of said platen means further includes a plurality of fixed dummy platens disposed in an alternate relationship with said platen rollers thereof and having a rounded top for applying a suitable frictional load to a print medium being fed by said print medium feeding means.

3. A printing apparatus as claimed in claim 2, wherein said dummy platens are disposed such that the rounded top ends thereof are positioned a little lower than the top ends of said platen rollers.

4. A printing apparatus as claimed in claim 2, wherein each of said dummy platens are secured to said housing by means of a pair of support members, and each of said platen rollers has a center shaft which is supported at the opposite ends thereof for rotation on adjacent ones of said support members for said dummy platens to the platen roller.

5. A printing apparatus as claimed in claim 1, wherein said print medium feeding means includes a plurality of feed rollers for contacting with a print medium to feed the print medium in the one direction, and each of locations at which adjacent ones of said platen rollers are contiguous to each other as viewed in the feeding direction of the print medium opposes to one of said feed rollers.

6. A printing apparatus as claimed in claim 1, wherein said print medium feeding means includes a shaft and a plurality of feed rollers securely mounted on said shaft for contacting with a print medium to feed the print medium in the one direction, each of said feed rollers being secured at two locations different by 180 degrees around said feed shaft at the axially opposite end portions thereof by means of a pair of fastening screws.

7. A printing apparatus as claimed in claim 1, wherein said housing includes a lower fixed housing member on which said platen means are mounted, and an upper movable housing member mounted on said fixed housing member for pivotal motion between an upper inoperative position and a lower operative position, said print medium feeding means including a plurality of feed rollers and a single cooperating element for cooperation with said feed rollers, said cooperating element being mounted on said lower fixed housing member while said line printing heads and said feed rollers are mounted on said movable housing member such that, when said movable housing member is in the operative position, said line printing heads and said feed rollers may be resiliently pressed against said platen means and said cooperating means, respectively, with a print medium interposed therebetween.

8. A printing apparatus as claimed in claim 7, wherein each of said platen means includes a plurality of platen rollers disposed in an opposing relationship to the printing elements on the line printing heads on a corresponding one of said pair of rows of line printing heads, and said upper movable housing member includes a tension applying element located between and extending in parallel to the two rows of said line printing heads such that, when said movable housing member is in the operative position, said tension applying element extends downwardly to a position below a plane of the top ends of said platen rollers to apply a tension to a print medium.

9. A printing apparatus as claimed in claim 7, further comprising an urging means for urging said upper movable housing member from the operative to the inoperative position, a manually operable rocking lever mounted for rocking motion between first and second positions on said lower fixed housing member and spring-urged to the first position, said rocking lever having a pin provided at an end portion thereof, and an arresting member fixedly mounted on said movable housing member for engaging with said pin on said rocking lever to arrest said upper movable housing member at the operative position against the urging force of said urging means, said arresting member having a first cam means for engaging, when said movable housing member is pivoted from the inoperative toward the operative position, with said pin to rock said rocking lever from the first toward the second position and a second cam means for engaging with said pin after disengaged from said first cam means to allow said rocking lever to be pivoted, by manual operation of said rocking lever, to the first position at which said upper movable housing member is arrested at the operative position.

* * * * *

UNITED STATES PATENT AND TRADEMARK OFFICE

CERTIFICATE OF CORRECTION

PATENT NO. : 4,946,297

DATED : August 7, 1990

INVENTOR(S) : Mitsuhito KOIKE, Toshiyuki Suzuki

It is certified that error appears in the above-identified patent and that said Letters Patent is hereby corrected as shown below:

Title page, item [57]:
Abstract Line 2, "mediumn" should read --medium--

Col. 6, Line 28, "an" should read --and--

Col. 6, Line 40, "Since of" should read --Since each of--.

Signed and Sealed this

Twenty-fourth Day of December, 1991

*Attest:*

HARRY F. MANBECK, JR.

*Attesting Officer*

*Commissioner of Patents and Trademarks*